US006412204B1

(12) United States Patent
Shoemaker et al.

(10) Patent No.: US 6,412,204 B1
(45) Date of Patent: Jul. 2, 2002

(54) SELF CENTERING DISPLAY FIXTURE

(75) Inventors: Gregory D. Shoemaker, Blue Springs, MO (US); Randy G. Postle, Shawnee, KS (US)

(73) Assignee: Hot Buys, Inc., Blue Springs, MO (US)

( * ) Notice: Subject to any disclaimer, the term of this patent is extended or adjusted under 35 U.S.C. 154(b) by 0 days.

(21) Appl. No.: 09/494,809

(22) Filed: Jan. 31, 2000

(51) Int. Cl.[7] ..... A47F 5/00; G09F 15/00
(52) U.S. Cl. ..... 40/607; 248/289.31; 40/608
(58) Field of Search ..... 40/607, 608, 606; 248/289.31, 145, 900

(56) References Cited

U.S. PATENT DOCUMENTS

| | | | | | |
|---|---|---|---|---|---|
| 2,054,281 | A | * | 9/1936 | Chauncey | 248/289.31 |
| 2,147,890 | A | * | 2/1939 | Glasgow | 248/289.31 |
| 3,637,178 | A | * | 1/1972 | Golden | 40/608 |
| 4,341,028 | A | * | 7/1982 | Brown | 40/606 |
| 4,616,799 | A | * | 10/1986 | Rebentisch | 248/289.3 |
| 5,233,773 | A | * | 8/1993 | Reynolds | 40/642 |
| 5,284,259 | A | | 2/1994 | Kump | |
| 5,375,803 | A | | 12/1994 | Kump | |
| 5,437,409 | A | * | 8/1995 | Coushaine | 248/900 |
| 5,458,242 | A | | 10/1995 | Baka et al. | |
| 5,470,138 | A | | 11/1995 | Kump | |
| D367,438 | S | | 2/1996 | Schriever | |
| 5,490,651 | A | | 2/1996 | Kump | |
| 5,549,054 | A | | 8/1996 | Lewis | |
| 5,553,721 | A | | 9/1996 | Gebka | |
| D381,041 | S | | 7/1997 | Lammers et al. | |
| 5,664,749 | A | | 9/1997 | Kump et al. | |
| 5,678,699 | A | | 10/1997 | Gebka | |
| 5,678,794 | A | | 10/1997 | Kump | |
| 5,682,698 | A | | 11/1997 | Bevins | |
| 5,683,003 | A | | 11/1997 | Gebka | |
| 5,720,398 | A | | 2/1998 | Kump et al. | |
| D397,366 | S | | 8/1998 | Wamsley | |
| D404,232 | S | | 1/1999 | Kump et al. | |
| 5,906,283 | A | | 5/1999 | Kump et al. | |
| 5,908,119 | A | | 6/1999 | Kump et al. | |
| 6,006,463 | A | | 12/1999 | Mueller | |
| 6,026,603 | A | | 2/2000 | Kump et al. | |
| D422,889 | S | | 4/2000 | Gray | |
| D423,336 | S | | 4/2000 | Gray | |
| D423,592 | S | | 4/2000 | Wamsley | |
| D424,121 | S | | 5/2000 | Kump | |
| D425,134 | S | | 5/2000 | Kump | |
| D425,566 | S | | 5/2000 | Mueller et al. | |
| D425,939 | S | | 5/2000 | Kump et al. | |
| 6,082,687 | A | | 7/2000 | Kump et al. | |
| 6,105,295 | A | | 8/2000 | Brinkman et al. | |
| 6,119,990 | A | | 9/2000 | Kump et al. | |
| 6,128,843 | A | | 10/2000 | Gebka | |
| 6,145,232 | A | | 11/2000 | Bevins | |
| 6,145,675 | A | | 11/2000 | Kass et al. | |
| 6,163,996 | A | | 12/2000 | Gebka | |
| 6,189,247 | B1 | | 2/2001 | Gebka | |
| D440,606 | S | | 4/2001 | Mueller | |
| 6,234,330 | B1 | | 5/2001 | Gray | |
| 6,289,618 | B1 | | 9/2001 | Kumpt, et al. | |

* cited by examiner

*Primary Examiner*—Lynne H. Browne
*Assistant Examiner*—Kenn Thompson
(74) *Attorney, Agent, or Firm*—Hovey Williams LLP

(57) ABSTRACT

A display fixture is provided for mounting to shelving in a retail store and presenting products or advertising so as to be more readily visible to the customer walking down the aisle. The display feature includes a mount, a coupler for attachment of the mount to an upright surface such as a support of shelving or other retail displays, a display arm swingably carried by the mount, and a centering device on the extension arm which is positioned for receipt in a depression such as a hole in the mount. In a centered position, the display arm has an extension arm portion which extends perpendicular to the upright surface with the centering device received in the depression, and which swings freely from the centered position with gravity returning the display arm to the centered position without the need for springs or other biasing devices. A product carrier and advertising display may be carried by the extension arm to extend into the aisle, and a screw may be threaded through the mount to hold the mount securely in position.

15 Claims, 1 Drawing Sheet

SELF CENTERING DISPLAY FIXTURE

BACKGROUND OF THE INVENTION

1. Field of the Invention

This invention concerns a display fixture useful at retail locations which is swingably mounted and centers itself to extend at an angle into the aisleway. More particularly, the display fixture hereof includes an arm carrying advertising or product at a remote end and at a proximate end is swingably held by a support mounted to conventional retail fixtures.

2. Description of the Prior Art

Various types of display fixtures are used in retail establishments to display goods. Shelves are most typically employed to carry products, but a variety of different clips and carriers extend from pegboards to provide product displays and advertising. Such fixtures are conventionally aligned along the aisles and on the ends of the aisles. It has been considered undesirable to extend product displays laterally into the aisles because they interfere with ordinary traffic. A more recent retail development has been the "warehouse" style of hardware and other stores, with products displayed on warehouse type shelving and wide aisles to accommodate motorized vehicles such as fork lifts used in carrying large quantities of items on the sales floor.

As a result, there has been an increasing need to take maximum advantage of retail display space in order to attract the attention of shoppers and to utilize space occupied by the aisles.

SUMMARY OF THE INVENTION

This object has largely been met by the present invention which enables the retailer to take further advantage of the retail sales floor by extending product displays laterally into the aisle. The present invention presents a multitude of advantages to the retailer, in that it is simple, uses unoccupied space, is substantially impervious to wear, resists tampering, and yields to both human and vehicular traffic by allowing the display arm to swing when engaged. The device hereof further permits not only the product itself to extend into the aisle in an eye-catching manner, but additional advertising to be displayed so as to be visible when the customer walks down the retail aisle.

Broadly speaking, the present invention includes a mount and a display arm swingably carried by the mount. The arm and mount cooperate so that the arm is not only self centering but accomplishes this without the need for any biasing mechanism. Further, the arm employs a centering device which aids in preventing excess swinging and helps to keep the arm positioned substantially normal to a mounting surface. The arm preferably includes a hinge portion at its proximal end and a product carrier at its remote end, whereby the product may be carried at an extended distance from the supporting surface. The product carrier may itself be swingably held relative to the arm so as to hang therefrom. An advertising carrier may be coupled to the display arm intermediate the proximate and distal ends of the normally horizontal portion.

The mount includes a backplate which may be attached to upright shelving supports or other mounting surface by a coupler. The coupler preferably includes hooks complementally configured to the respective mounting surface so that the mount may drop into place. A tightening screw is provided on the mount to maintain tension and resist tampering. An arm support extends downwardly at an angle from the backplate to receive the hinge portion of the arm, and further includes a recess for cooperating with the centering device.

As a result, the fixture is sturdy, easy to mount and maintain, and substantially safer than ordinary fixtures which fail to yield when encountered. The device is inexpensive to manufacture and requires no biasing mechanisms such as springs to maintain the extended orientation. By using a hanging product carrier, multiple articles may be carried and presented to attract the purchasers attention. These and other advantages will be readily understood by those skilled in the art with reference to the attached drawings.

DESCRIPTION OF THE PREFERRED EMBODIMENT

Figure 3:
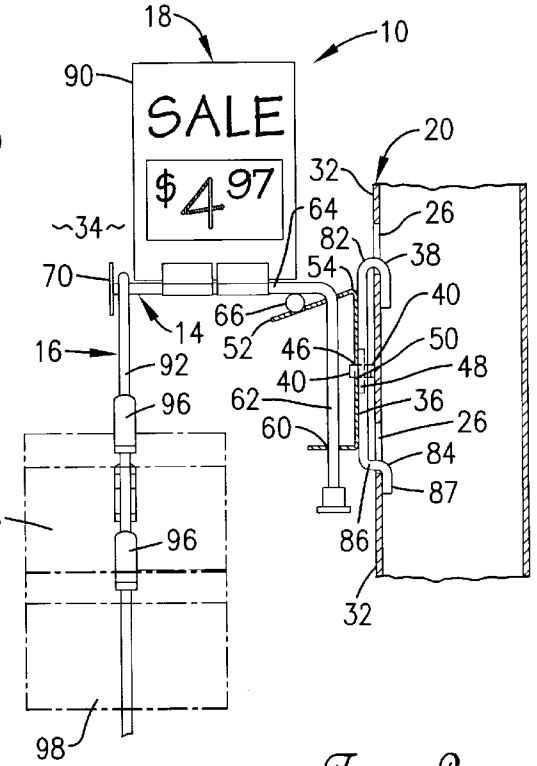
FIG. 3 is a side elevation view showing the display arm in an extended orientation into the aisleway of a retail facility.

Referring now to the drawing, a self-centering display fixture 10 broadly includes a mount 12, a display arm 14 swingably carried by the mount 12, a product carrier 16 carried remotely on the arm 14 from the mount, an advertising display 18 coupled to the display arm 14, and mounting surface 20 to which the mount 12 is coupled. As shown in the drawing, mounting surface 20 is provided of upright shelving supports 22 and 24 in parallel, side by side disposition, each having keyhole-shaped mounting openings 26 of contiguous hole portions 28 and slot portions 30 in a face 32 oriented toward the aisle 34, the slot portions 30 having narrower transverse dimensions than the hole portions 28. However, this is merely provided as an example of one type of mounting support for the fixture 10, and it may be appreciated that there are numerous types of shelving, display racks and other commercial fixtures which may be used to support the invention hereof.

Figure 4:
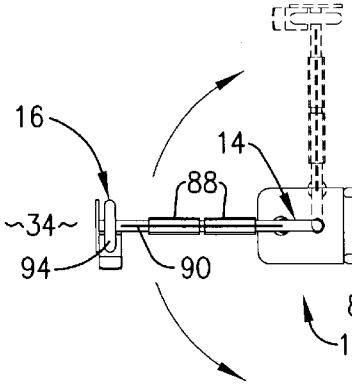
FIG. 4 is a top plan view showing the arm and product carrier centered and in deflected positions in phantom.

In greater detail, the mount 12 includes a backplate 36, coupler 38, securing screw 40, arm support 42 and lower hinge flange 44. The backplate 36 is normally oriented to be upright and parallel to face 32, with its back side oriented toward face 32 and its front side oriented away from the face 32. An opening 46 is preferably centered in the backplate 36 to receive securing screw 40 therethrough, and a backing 48 is then affixed by welding or the like to the back side of the backplate as shown in FIG. 3, the backing having an internally threaded bore 50 therethrough. Securing screw 40 is preferably an Allen screw which inhibits tampering. The arm support 42 and lower hinge flange 44 are preferably integrally formed with backplate 36 by bending metal to the desired configuration toward the front side of the backplate 36. Arm support 42 is bent downwardly relative to the horizontal so that its outboard edge 52 is lower than its inner comer 54, and extends forwardly from the front side of the backplate 36 as shown in FIG. 3. A centering depression provided as centering hole 56 and an upper hinge hole 58 are provided in the arm support 42, the hinge hole 58 being located more proximate to the inner comer 54 and the centering hole 56 being located more proximate to the outboard edge 52. The centering hole 56 and upper hinge hole 58 are preferably centered on the width W of the arm support 42 to enhance bidirectional swinging and centering, as illustrated in FIG. 4. The lower hinge flange 44 extends forwardly from the front side of the backplate 36 in a direction preferably substantially perpendicular to the backplate 36 and has a lower hinge hole 60 which is preferably in vertical alignment with upper hinge hole 58 to define a vertical pivot axis for the display arm 14 when in use.

The display arm 14 is preferably bent to be substantially L-shaped and includes an upright pivot rod 62 passing through the hinge holes 58 and 60 an extension arm 64 oriented generally normal thereto. A centering device 66 is fixed to the extension arm 64. The extension arm 64 has a proximal end 68 at the bend and a remote end having a stop 70 in the shape of a disc preferably permanently affixed thereto. The pivot rod 62 has a lower end 72 to which a removable cap 74 is removably attached. The centering device 66 is preferably a sphere 76 welded to the underside of the extension arm 64 and positioned so that when the pivot arm 62 is swingably received in the hinge holes 58 and 60 and the extension arm is generally perpendicular to the backplate 36, the sphere 76 is received in centering hole 56, with the diameter of the sphere 76 being greater than the diameter of the centering hole 56.

Figure 2:
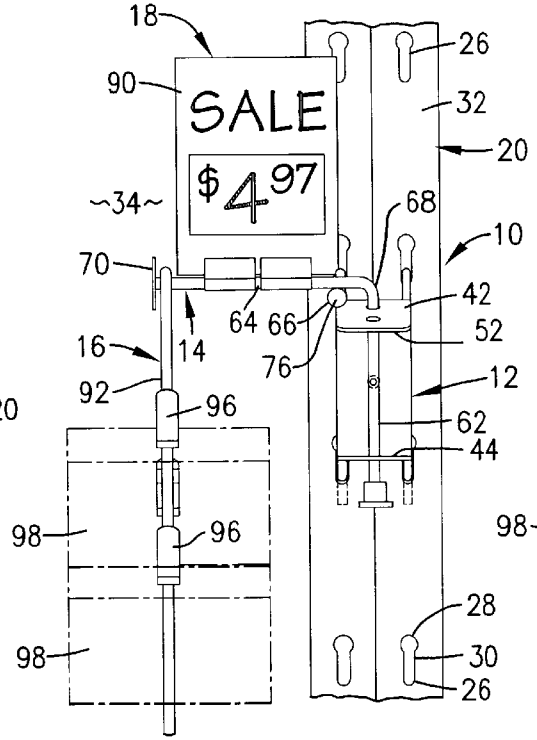
FIG. 2 is a front elevation view of the invention mounted to a shelving support, showing the arm pivoted to the side with an advertising display coupled to the display arm and two articles of merchandise clipped to the product carrier shown in phantom.
Figure 1:
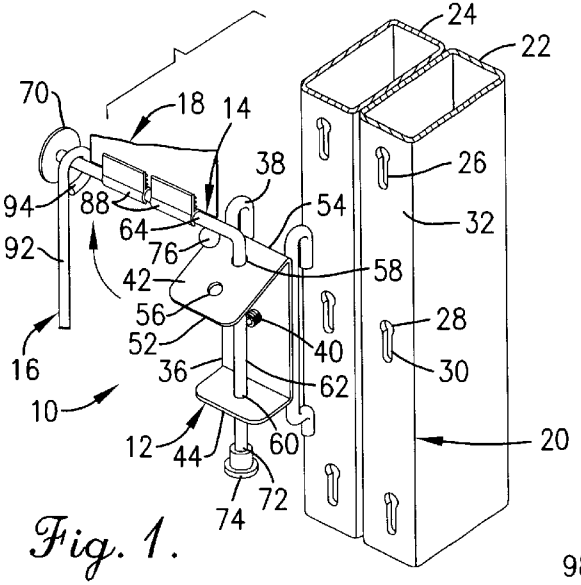
FIG. 1 is a perspective view of the fixture of the present invention, showing the product carrier foreshortened and the mount ready for attachment to the upright support of a shelving structure.

The coupler 38 is preferably provided as hooks 78 and 80 laterally spaced on the back side of backplate 36 the same distance apart as the mounting openings 26 on the shelving supports 22 and 24 and preferably of steel welded to the backplate 36. The hooks 78 and 80 each include an upper bend 82 and a lower L-shaped insert 84, spaced vertically as shown in FIGS. 2 and 3 to correspond to vertical spacing intervals of the mounting openings of the shelving supports 22 and 24. The insert 84 includes an inward element 86 and a downward stretch 86. When coupled to the support surface 20, the upper bends 82 pass through one pair of mounting openings 26 and the inserts 84 pass into a lower pair of mounting openings 26.

The advertising insert 18 includes at least one clip 88 removably attached to the extension arm 64 and a display 90 attached thereto. The display 90 may be in the form of a card or other display device such as a light which catches the customer's attention and may include indicia containing information about the product, such as price, description or the like.

The product carrier 16 includes a hanger 92 of, for example, wire or rod-like construction, which has a loop 94 at the upper end thereof, and at least one and preferably a plurality of attachments 96 such as clips connected to the hanger and from which individual products 98 may be removably secured. It may be appreciated that the attachments may also include hooks, prongs or other devices to which the products may be readily attached and removed. The loop 94 is of sufficient inside diameter to pass over the combined diameters of the extension arm 64 and sphere 76, but of insufficient diameter to permit passing over stop 70.

The display arm 14 and mount 12, and particularly the upper surface of the aim support 42 and centering device 66, are painted or otherwise coated with a glossy paint or other coating which promotes sliding of the sphere across the upper surface of the arm support 42. The arm support 42 also preferably is of a sufficient width W, and the centering device 66 is located on the extension arm 64 so that the centering device 66 remains on the arm support 42 during swinging of its full range of motion as illustrated in FIG. 4. The extension arm portion of the display arm is shown in its centered position in solid lines in FIG. 4, and also in a 90 degree displacement from the centered position in phantom lines. It is to be understood, as shown by the arrows, that the extension arm is equally capable of swinging through a 90 degree range in the opposite direction, so that a total range of motion is at least 180 degrees in the preferred embodiment.

In use, the display fixture 10 is assembled by first slipping the loop 94 of the product carrier 16 over the lower end 72 and sliding it therealong to the remote end 70 of the extension arm 64. The advertising display 18 is then clipped to the extension arm 64. The mount 12 is attached to the mounting surface 20 by first inserting the insert 84 of each of the hooks 78 and 80 into a pair of mounting openings 26 and thereafter inserting the upper bends 82 into a second pair of mounting openings 26 located above the first pair. The mount 72 is allowed to drop, whereby the hooks 78 and 80 pass downwardly into the slot portions of the mounting openings 26. In this position, the upper hinge hole 58 and the lower hinge hole 60 are in vertical alignment, as shown in FIGS. 2 and 3. The securing screw 40 is then tightened against the mounting surface 20 to hold the mount 12 in proper position.

Once the mount 12 is positioned, the lower end 72 of the pivot rod 62 is passed through each of the upper hinge hole 58 and lower hinge hole 60, and the cap 74 is attached to the lower end 72 to inhibit removal. The individual products 98 are then placed on the attachments 96, and the display fixture 10 is ready for use.

As the extension arm 64 extends into an aisle 34, it may be touched by a customer or struck by a vehicle. In that instance, the display arm 14 is free to swing so that the extension arm 64 and product carrier 16 yield to the force applied. As the extension arm swings, the sphere 76 moves out of centering hole 56 and slides across the upper surface of the arm support 42. The angled upper surface of the arm support 42 thereby causes the display arm 14 to increase in height as it swings across the arm support. When the display arm 14 is free to swing back, gravity acts on the arm and the low frictional resistance between the sphere 76 and the upper surface of the arm support 42 allows gravity along to act on the display arm and cause it to return to its original, centered position as shown in FIG. 3. During such swinging, the extension arm 64 might move through a multiplicity of oscillations, but the sphere 76 drops partially into the centering hole 56, located at the lowermost position possible during swinging and thus the natural position of repose, during each swinging movement. This retards further swinging movement and as a result, the extension arm 64 quickly returns to its normal and desired position substantially perpendicular to the face of the mounting surface. It may be appreciated that the additional weight of the individual products on the product carrier 16 only serves to increase the weight on the sphere 76 and improves the resulting performance of the display fixture 10 without significantly inhibiting its ability to swing once touched. The fact that the product carrier 16 is itself swingably mounted to the extension arm 64 also helps the avoid damage to the display fixture 10 or damage to the individual products 98 resulting from impact or dislodgement causing them to fall to the floor of the aisle.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention. As examples of such modifications, the mount 12 may be modified for attachment to a variety of different supports, including walls and horizontal surfaces, and the centering device may be modified from a sphere to other configurations which aid self-centering of the arm 14. The fixture 10 may be manufactured in a variety of methods, including die casting, cutting from sheet stock, as well as fabrication and welding, and the fixture or components thereof may be molded of synthetic resin as well as metal such as steel or aluminum.

The inventors hereby states their intent to rely on the Doctrine of Equivalents to determine and assess the reasonably fair scope of his/their invention as pertains to any apparatus not materially departing from but outside the literal scope of the invention as set out in the following claims.

What is claimed is:

1. A display fixture for mounting to a supporting surface comprising:

a mount presenting a back having a front side and a rear side, an arm support angularly oriented and extending downwardly and forwardly from the front side of the back, the arm support having an upper hinge hole relatively proximate said backing member and a centering depression relatively remote from said backing member, and a lower hinge flange extending angularly from the front side of said back and having a lower flange hole substantially aligned with said upper hinge hole;

a display arm having a pivot arm portion swingably carried by said mount and passing through said upper hinge hole and lower hinge hole, and an extension arm portion angularly oriented relative to said pivot arm portion, and a centering device attached to said extension arm portion, said centering device being positioned on said extension arm portion so as to engage said centering depression in a centered position substantially perpendicular to said back and to permit swinging movement of said display arm from said centered position, wherein said centering device has an arcuate outer surface received in said centering depression; and a coupler attached to said mount proximate the rear side of said back for orienting said pivot arm in an upright axis when said display fixture is mounted to the mounting surface.

2. A display fixture as set forth in claim 1, wherein said centering device is a sphere.

3. A display fixture for mounting to a supporting surface comprising:

a mount presenting a back having a front side and a rear side, an arm support angularly oriented and extending downwardly and forwardly from the front side of the back, the arm support having an upper hinge hole relatively proximate said backing member and a centering depression relatively remote from said backing member, wherein said centering depression is a hole in said arm support, and a lower hinge flange extending angularly from the front side of said back and having a lower flange hole substantially aligned with said upper hinge hole;

a display arm having a pivot arm portion swingably carried by said mount and passing through said upper hinge hole and lower hinge hole, and an extension arm portion angularly oriented relative to said pivot arm portion, and a centering device attached to said extension arm portion, said centering device being positioned on said extension arm portion so as to engage said centering depression in a centered position substantially perpendicular to said back and to permit swinging movement of said display arm from said centered position; and a coupler attached to said mount proximate the rear side of said back for orienting said pivot arm in an upright axis when said display fixture is mounted to the mounting surface.

4. A display fixture as set forth in claim 3, wherein said hole in said arm support has a diameter sufficiently small to present the passage of the centering device therethrough.

5. A display fixture for mounting to a supporting surface comprising:

a mount presenting a back having a front side and a rear side, an arm support angularly oriented and extending downwardly and forwardly from the front side of the back, the arm support having an upper hinge hole relatively proximate said backing member and a centering depression relatively remote from said backing member, and a lower hinge flange extending angularly from the front side of said back and having a lower flange hole substantially aligned with said upper hinge hole;

a display arm having a pivot arm portion swingably carried by said mount and passing through said upper hinge hole and lower hinge hole, and an extension arm portion angularly oriented relative to said pivot arm portion, and a centering device attached to said extension arm portion, said centering device being positioned on said extension arm portion so as to engage said centering depression in a centered position substantially perpendicular to said back and to permit swinging movement of said display arm from said centered position; and a coupler attached to said mount proximate the rear side of said back for orienting said pivot arm in an upright axis when said display fixture is mounted to the mounting surface, wherein said coupler includes at least one hook.

6. A display fixture for mounting to a supporting surface comprising:

a mount presenting a back having a front side and a rear side, an arm support angularly oriented and extending downwardly and forwardly from the front side of the back, the arm support having an upper hinge hole relatively proximate said backing member and a centering depression relatively remote from said backing member, and a lower hinge flange extending angularly from the front side of said back and having a lower flange hole substantially aligned with said upper hinge hole, and a screw threadably received in said back;

a display arm having a pivot arm portion swingably carried by said mount and passing through said upper hinge hole and lower hinge hole, and an extension arm portion angularly oriented relative to said pivot arm portion, and a centering device attached to said extension arm portion, said centering device being positioned on said extension arm portion so as to engage said centering depression in a centered position substantially perpendicular to said back and to permit swinging movement of said display arm from said centered position; and a coupler attached to said mount proximate the rear side of said back for orienting said pivot arm in an upright axis when said display fixture is mounted to the mounting surface.

7. A display fixture for mounting to a supporting surface comprising:

a mount presenting a back having a front side and a rear side, an arm support angularly oriented and extending downwardly and forwardly from the front side of the back, the arm support having an upper hinge hole relatively proximate said backing member and a centering depression relatively remote from said backing member, and a lower hinge flange extending angularly from the front side of said back and having a lower flange hole substantially aligned with said upper hinge hole;

a display arm having a pivot arm portion swingably carried by said mount and passing through said upper hinge hole and lower hinge hole, and an extension arm portion angularly oriented relative to said pivot arm portion, and a centering device attached to said extension arm portion, said centering device being positioned on said extension arm portion so as to engage said centering depression in a centered position substantially perpendicular to said back and to permit swinging movement of said display arm from said centered position;

a coupler attached to said mount proximate the rear side of said back for orienting said pivot arm in an upright axis when said display fixture is mounted to the mounting surface; and an advertising display coupled to said extension arm portion, said advertising display including at least one clip and a card held by said clip in substantially coplanar relationship to said extension arm.

8. A display fixture for mounting to a supporting surface comprising:

a mount presenting a back having a front side and a rear side, an arm support angularly oriented and extending downwardly and forwardly from the front side of the back, the arm support having an upper hinge hole relatively proximate said backing member and a centering depression relatively remote from said backing member, and a lower hinge flange extending angularly from the front side of said back and having a lower flange hole substantially aligned with said upper hinge hole;

a display arm having a pivot arm portion swingably carried by said mount and passing through said upper hinge hole and lower hinge hole, and an extension arm portion angularly oriented relative to said pivot arm portion, and a centering device attached to said extension arm portion, said centering device being positioned on said extension arm portion so as to engage said centering depression in a centered position substantially perpendicular to said back and to permit swinging movement of said display arm from said centered position;

a coupler attached to said mount proximate the rear side of said back for orienting said pivot arm in an upright axis when said display fixture is mounted to the mounting surface; and a product carrier supported on said extension arm portion arranged for externally displaying a product coupled to said product carrier.

9. A display fixture as set forth in claim 8, wherein said product carrier is swingably coupled to said extension arm portion.

10. A display fixture as set forth in claim 9, wherein said product carrier includes a hanger presenting a loop receiving said extension arm portion therethrough.

11. A display fixture as set forth in claim 10, wherein said extension arm portion includes a remote end and a stop connected to said extension arm portion at said remote end, and wherein said stop is configured to prevent the passage of the loop therepast.

12. In a retail display including an upright support presenting a front face having a plurality of vertically aligned openings therein, the improvement comprising a display fixture having:

a mount presenting a back having a front side and a rear side, an arm support angularly oriented and extending downwardly and forwardly from the front side of the back, the arm support having an upper hinge hole relatively proximate said backing member and a centering depression relatively remote from said backing member, and a lower hinge flange extending angularly from the front side of said back and having a lower flange hole substantially aligned with said upper hinge hole;

a display arm having a pivot arm portion swingably carried by said mount and passing through said upper hinge hole and lower hinge hole, and an extension arm portion angularly oriented relative to said pivot arm portion, and a centering device attached to said extension arm portion, said centering device being positioned on said extension arm portion so as to engage said centering depression in a centered position substantially perpendicular to said back and to permit swinging movement of said extension arm portion from said centered position; and a coupler attached to said mount proximate the rear side of said back and inserted through said openings for coupling the mount to said upright support with said pivot arm oriented in an upright axis, whereby the height of said display arm increases during swinging of said extension arm portion from its centered position.

13. A retail display as set forth in claim 12, including a screw threadably coupled to said back for engaging the face of the upright support.

14. A retail display as set forth in claim 12, including a product carrier swingably carried by the extension arm portion.

15. A retail display as set forth in claim 12, including an advertising display coupled to said extension arm portion.

* * * * *